US012714935B2

(12) United States Patent
Chiu

(10) Patent No.: US 12,714,935 B2
(45) Date of Patent: Aug. 25, 2026

(54) SWINGING AND REVOLVING GAME APPARATUS

(71) Applicant: KIDDIE'S PARADISE INC., Taipei (TW)

(72) Inventor: Yen-Po Chiu, Taipei (TW)

(73) Assignee: KIDDIE'S PARADISE INC., Taipei (TW)

( * ) Notice: Subject to any disclaimer, the term of this patent is extended or adjusted under 35 U.S.C. 154(b) by 426 days.

(21) Appl. No.: 18/538,163

(22) Filed: Dec. 13, 2023

(65) Prior Publication Data

US 2025/0195991 A1 Jun. 19, 2025

(51) Int. Cl.
*A63F 9/16* (2006.01)

(52) U.S. Cl.
CPC ..... *A63F 9/16* (2013.01)

(58) Field of Classification Search
None
See application file for complete search history.

(56) References Cited

U.S. PATENT DOCUMENTS 3,586,321 A * 6/1971 Gehrke ..... A63G 23/00 482/146
5,503,411 A * 4/1996 Sundberg ..... B62K 9/02 280/282
8,202,172 B1 * 6/2012 LeJeune ..... A63G 13/06 472/134
2006/0255552 A1 * 11/2006 Wojnowski ..... B62B 15/00 280/18

* cited by examiner

*Primary Examiner* — Eugene L Kim
*Assistant Examiner* — Samantha M Berry
(74) *Attorney, Agent, or Firm* — Best & Flanagan LLP

(57) ABSTRACT

The present invention discloses a swinging and revolving game apparatus structured to include an arc-shaped game body, the curved arc-shaped poles at the bottom of the game body is used to allow the game body to swing left and right, the characterized in that: the bottom of the game body has at least one 8-shaped inlay slot, when game unit of different shapes is positioned in the 8-shaped inlay slot of the game body by using at least one 8-shaped inlay slot on the top of the game unit, it can provide the game body for playing in addition to back and forth swinging and rotating games, the game body can also be provided for seesaw games, thus providing children with a diversified game device.

4 Claims, 5 Drawing Sheets

SWINGING AND REVOLVING GAME APPARATUS

BACKGROUND OF THE INVENTION a) Field of the Invention

The present invention relates to a swinging and revolving game apparatus, and more particularity to an innovative swing game body, a game unit can be installed at the bottom of the game body, the game body can be supported the combination of different swing directions to achieve the game functions of front and back, left and right swing, rotation and seesaw.

b) Description of the Prior Art

The most of the traditional game equipment with swing function can only provide a single swing game function, therefore, the game equipment is very monotonous and unchanging, and cannot inspire children to play the game of swinging in one direction, and it can also play both front and rear, left and right; the game function that can produce swings in all directions can no longer provide diversified games such as rotation or seesaw, therefore, there is a need to re-develop and improve the existing swing game equipment and facilities.

In view of this, the creator has accumulated many years of experience, carefully researched and continuously tested and improved, now he has finally created an innovative game device that can swing forward, left, right and rotate, which can eliminate the shortcomings of conventional products and improve its effectiveness.

SUMMARY OF THE INVENTION

Accordingly, the primary object of the present invention is to provide a game device that can swing back and forth, left and right, and rotate, which is an arc-shaped game body, the two curved arc-shaped poles at the bottom of the game body can be used to play the game of swinging left and right; the main features of the present invention is: the bottom of the game body has at least one 8-shaped inlay slot, and the top of the game unit of different shapes is equipped with at least one 8-shaped inlay block; the game unit uses the inlay block to be embedded in the inlay slot of the game body for positioning. When children sit or lie on the game body, through the setting of the game unit, they can simultaneously play forward and backward swinging games, or swing left and right, they can also use the game unit to perform various games such as rotation or seesaw.

In the above-mentioned swinging and revolving game apparatus, an arc-shaped handrail is provided on the top edge of the left and right sides of the game body to facilitate children to hold during the swing game.

In the above-mentioned swinging and revolving game apparatus, a triangular arc-shaped stopper is provided at the center of both sides of the bottom of the game body, the stopper can prevent children from overturning during the swing game and has a safety effect.

In the above-mentioned swinging and revolving game apparatus, a groove is provided on the front and rear sides of the bottom of the game body, the groove allows children to lift the game body with their hands for easy portability; when the game body is installed on the game unit to facilitate children to swinging back and forth, the groove can also be used as an armrest for children to hold.

In the above-mentioned swinging and revolving game apparatus, the bottom of the game unit is designed in an arc shape, so that the game body can swing forward, left, right, and rotate or be used as a seesaw after the game unit is installed.

In the above-mentioned swinging and revolving game apparatus, the front and rear sides of the game unit are respectively provided with semi-arc-shaped lugs, when the game unit is installed on the game body and swings back and forth, the lugs are located on the stopper of the game body to prevent the protruding lugs of the game unit from causing safety concerns.

In the above-mentioned swinging and revolving game apparatus, the top of the game unit has a slot, when the game unit is installed on the game body and swings back and forth, the slot can facilitate children to remove the game unit from the game body.

DETAILED DESCRIPTION OF THE PREFERRED EMBODIMENTS

Figure 1:
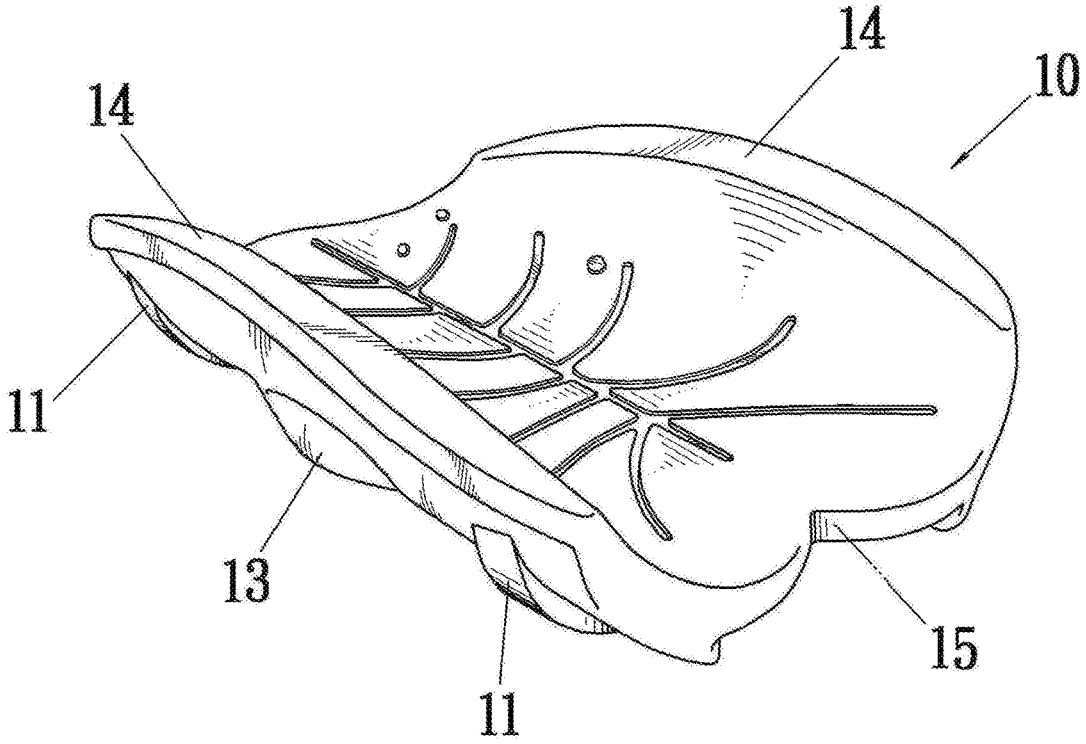
FIG. 1 shows a schematic external appearance of the game body of the present invention.
Figure 2:
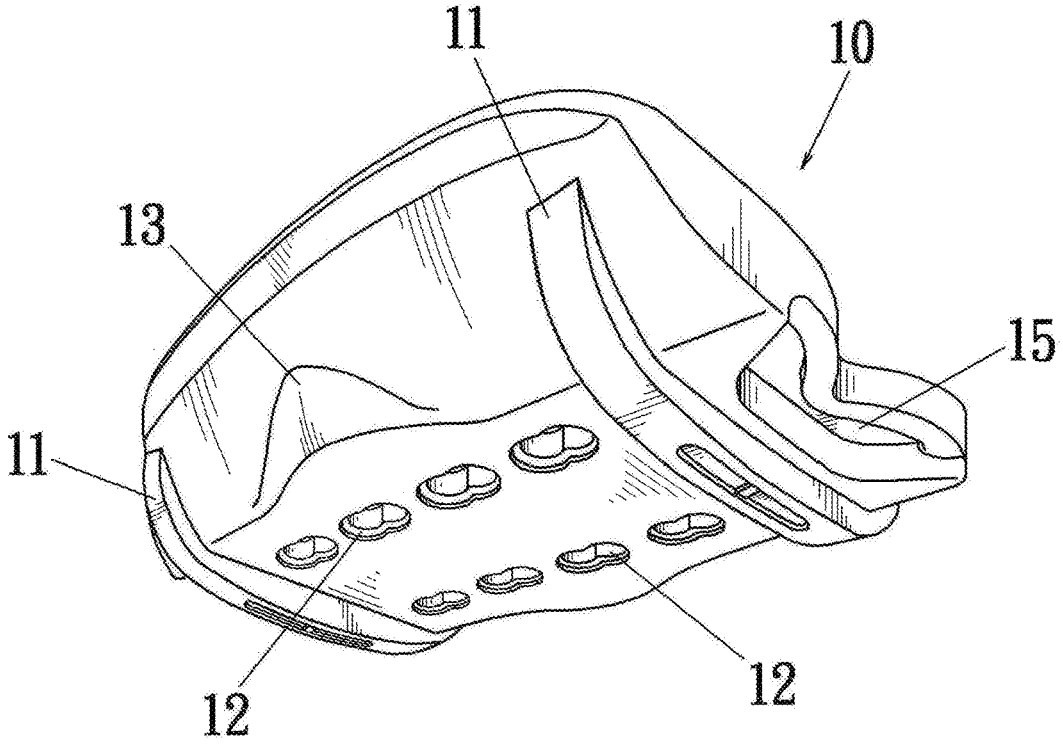
FIG. 2 shows a bottom schematic external appearance of the game body of the present invention.
Figure 3:
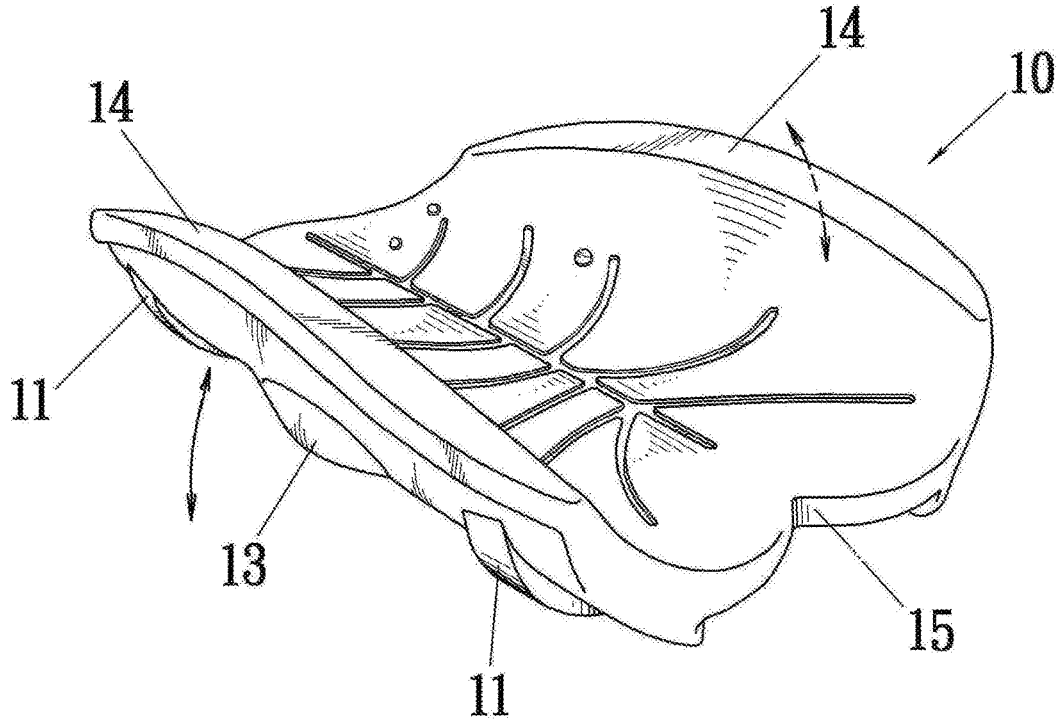
FIG. 3 shows a usage status diagram of the game body of the present invention.
Figure 4:
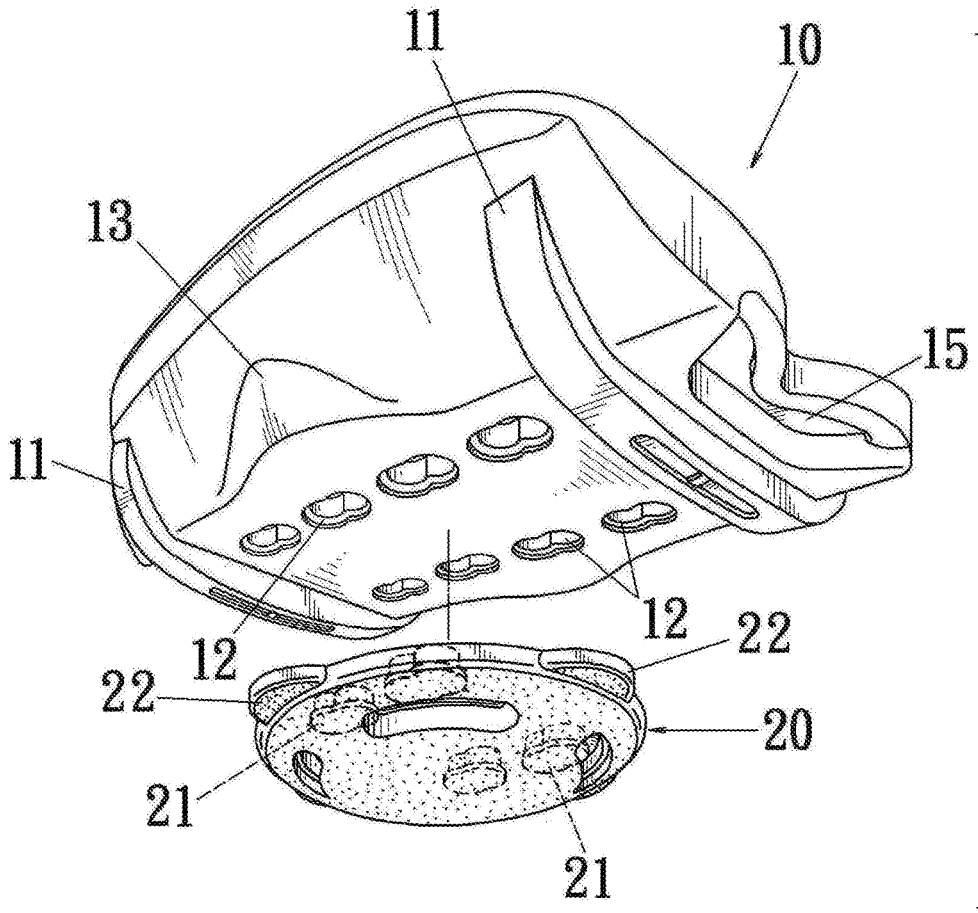
FIG. 4 shows an exploded view of the game body of the present invention combined with the game unit of the first embodiment.
Figure 5:
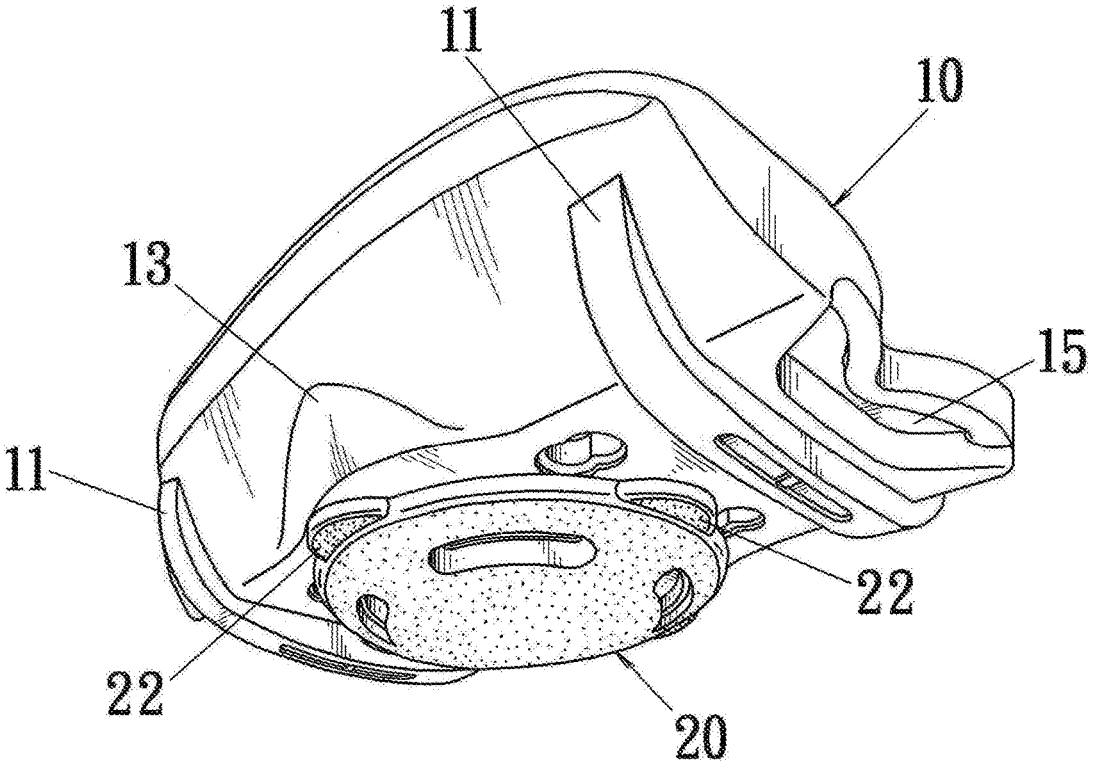
FIG. 5 shows a bottom schematic external appearance of the game body of the present invention, when it is combined with the game unit of the first embodiment.
Figure 6:
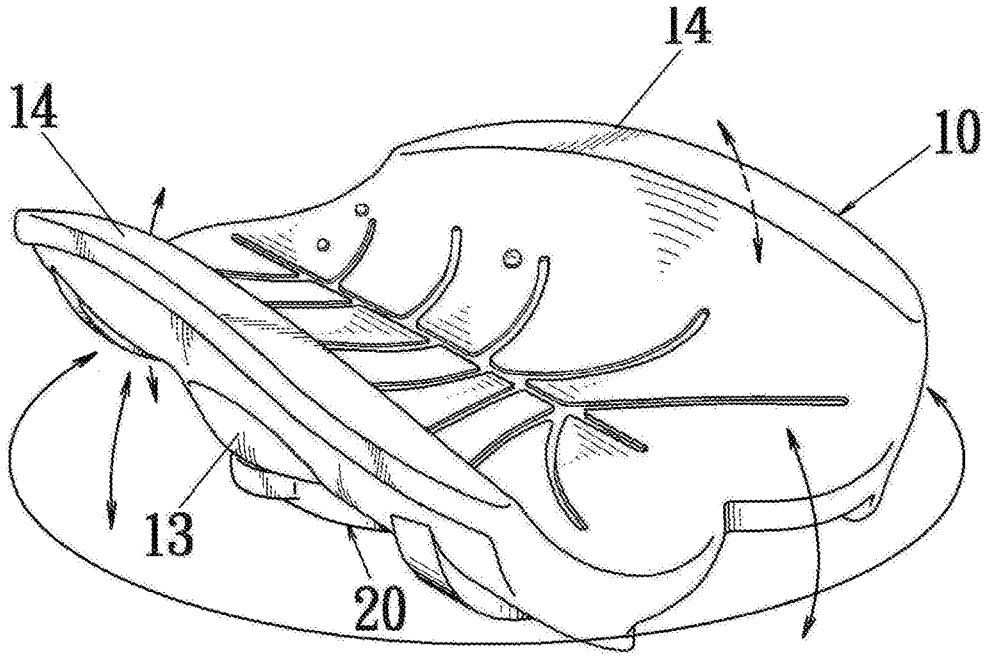
FIG. 6 shows a usage status diagram, when the game body of the present invention is combined with the game unit of the first embodiment.

Referring to FIGS. 1 and 2, which show a swinging and revolving game apparatus of the present invention structured to comprise a game body 10, the game body 10 is shaped like an arc and has two curved arc-shaped poles 11 at the bottom; as shown in FIG. 3, the game body 10 uses two poles 11 for children to play left and right swing games; the main feature of the present invention is: the bottom of the game body 10 has at least one 8-shaped inlay slot 12. Referring to FIGS. 4 and 5, the first embodiment of the present invention, when a disc-shaped game unit 20 is combined with the game body 10, at least one 8-shaped inlay block 21 on the top of the game unit 20 is embedded in the game body 10, it is worth mentioning that the inlay block 21 and the inlay slot 12 of the present invention are designed to be shaped like a 8-shaped, instead of being designed to be circular or oval, so that the inlay block 21 and the inlay slot 12 are connected in a 8-shaped, in this way, in addition to not causing the inlay block 21 of the game unit 20 to wear and loosen under long-term use, it also has a tight combination of firmness and safety during play; refer to FIG. 6, the above-mentioned game body 10 is combined with the game unit 20 can also play back and forth swinging games, when the game unit 20 is combined at the center of the bottom of the game body 10, the arc-shaped game unit 20 can be used as a rotating shaft, the game body 10 can be used by children to play rotating games.

Furthermore, a triangular arc-shaped stopper 13 is provided at the center of both sides of the bottom of the game body 10, the stoppers 13 can prevent the game body 10 from overturning when children are playing swing games.

In addition, an arc-shaped handrail 14 is respectively provided on the top edge of the left and right sides of the game body 10 to facilitate children to hold it during swing games.

There are grooves 15 on the front and rear sides of the bottom of the game body 10 respectively, the grooves 15 are convenient for children to lift the game body 10 with their hands for easy portability; when the game body 10 is installed with the game unit 20 for forward and backward swinging or rotating games, the grooves 15 can also be used by children to hold.

Referring to FIGS. 4 to 5, the front and rear sides of the game unit 20 are respectively provided with semi-arc-shaped lugs 22, when the game unit 20 is combined with the game body 10, the lugs 22 are located on the stoppers 13 of the game body 10 is provided to prevent the protruding lugs 22 of the game unit 20 from causing safety concerns.

Figure 7:
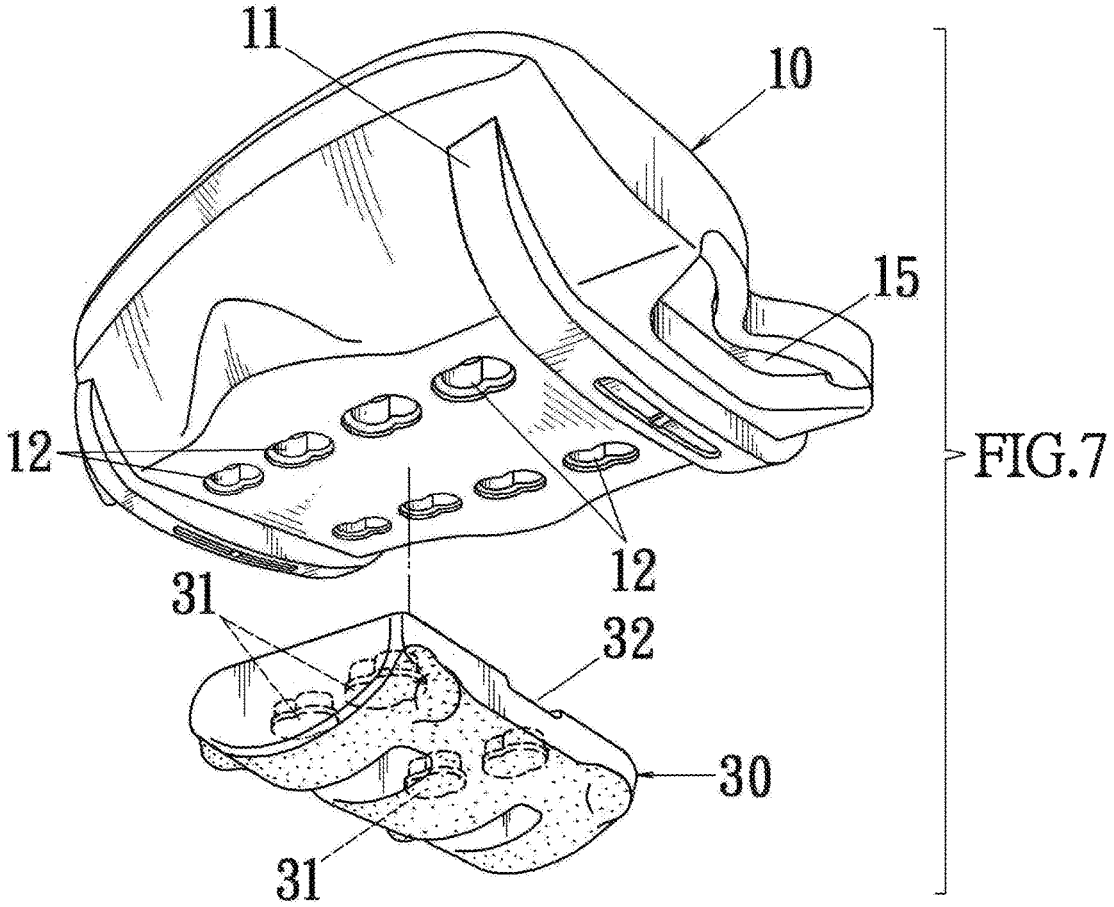
FIG. 7 shows an exploded view of the game body of the present invention combined with the game unit of the second embodiment.
Figure 8:
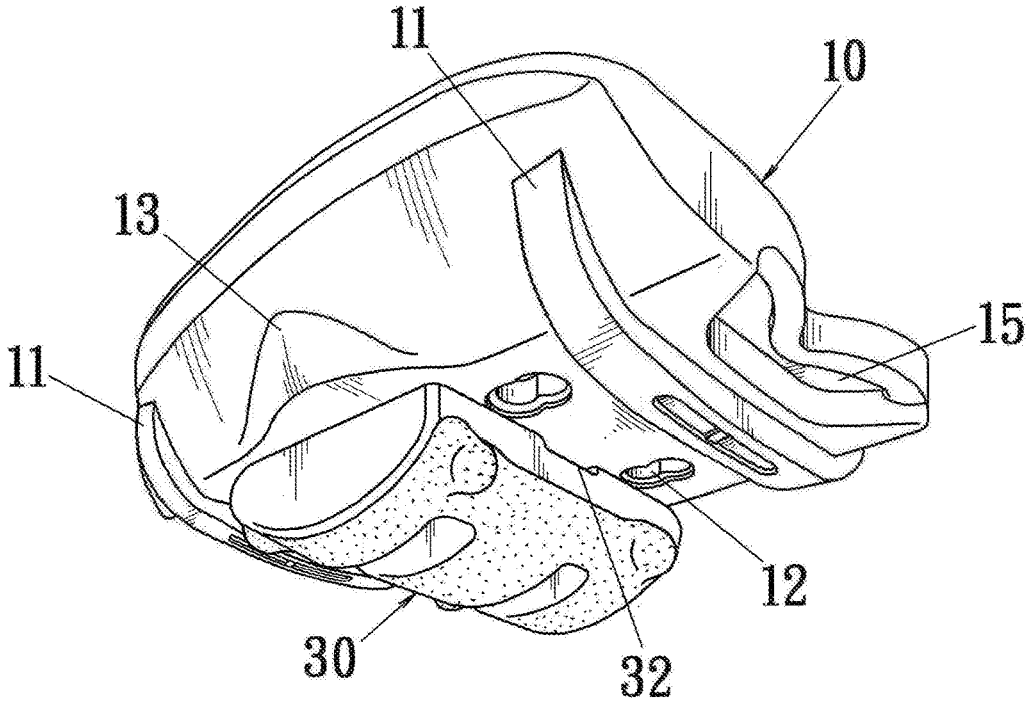
FIG. 8 shows a bottom schematic external appearance of the game body of the present invention, when it is combined with the game unit of the second embodiment.
Figure 9:
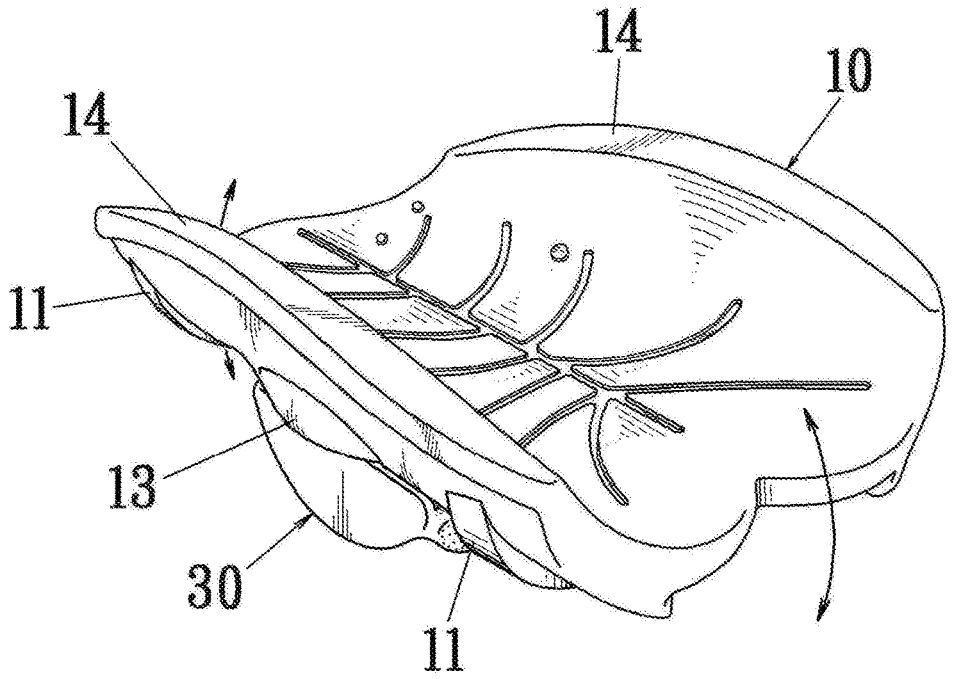
FIG. 9 shows a usage status diagram, when the game body of the present invention is combined with the game unit of the second embodiment.

Referring to FIGS. 7 to 9, which are the second embodiment of the rectangular arc-shaped game unit 30 of the present invention, the game unit 30 of different shapes utilizes at least one 8-shaped inlay block 31 at the top and when at least one 8-shaped inlay slot 12 at the bottom of the game body 10 is combined, the game of swinging back and forth can also be played; and the left and right ends of the top of the game unit 30 have a slot 32 respectively, and the slots 32 can facilitate children to move the game unit 30 is detached from the game body 10.

Figure 10:
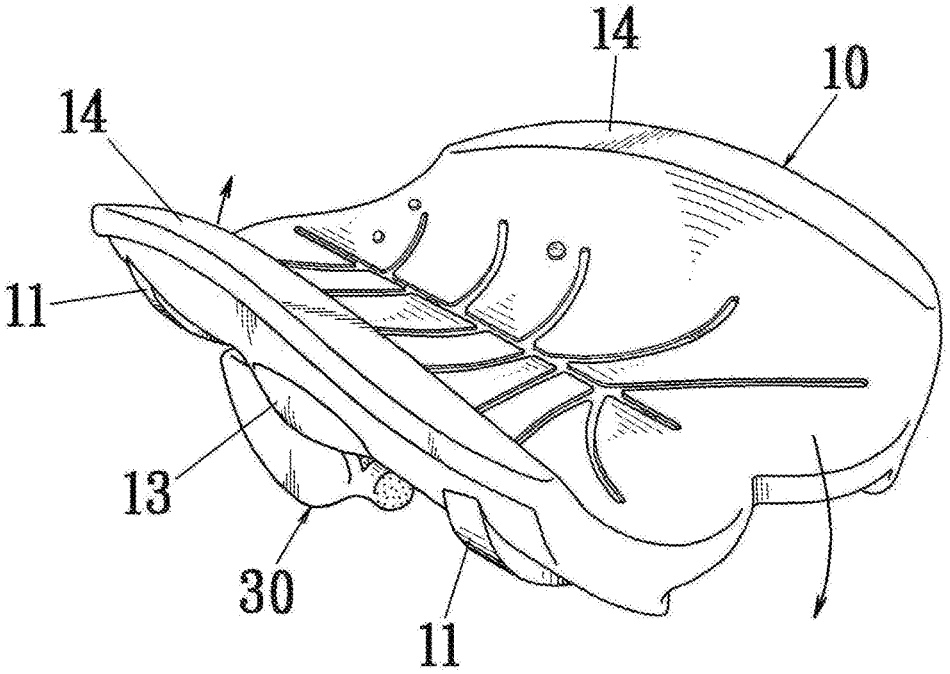
FIG. 10 shows another usage state diagram, when the game body of the present invention is combined with the game unit of the second embodiment.

Referring to FIG. 10, the 8-shaped inlay block 31 on the top of the game unit 30 of the present invention is inserted into the 8-shaped inlay slot 12 on the bottom side of the game body 10 (or the inlay slot 12 in the center), so that the game unit 30 can be used as a lever is formed at the bottom of the game body 10 for children to play the seesaw on the game body 10.

In conclusion, according to the above description of the embodiments of the present invention, it is matched with game units of different shapes and pass through different swing direction combinations, it can swing forward and backward, left and right, and rotate, seesaw and other diverse games; its practical efficacy is beyond doubt, and the present invention has never been made public or has been seen in other publications, it has indeed complied with the provisions of the patent law, and a patent application has been filed in accordance with the law.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A swinging and revolving game apparatus comprising:

a game body, the bottom of the game body has two poles, the two poles can be used to swing the game body left and right, the bottom of the game body has at least one 8-shaped inlay slot, the bottom of the game body has a triangular arc-shaped groove in the center of both sides; and at least one game unit, the top of the game unit has at least one 8-shaped inlay block, the game unit uses at least one 8-shaped inlay block to be embedded in the 8-shaped inlay slot of the game body, the above game body can pass through different swing directions, combined to achieve the game functions of front and back, left and right swing, rotation and seesaw wherein a semi-arc-shaped lug is on the front and rear sides of the game unit, when the game unit is combined with the game body, the lug is mounted on the base of the game unit.

2. The swinging and revolving game apparatus according to claim 1, wherein an arc-shaped handrail on the top edges of the left and right sides of the game body.

3. The swinging and revolving game apparatus according to claim 1, wherein a groove on the front and rear sides of the bottom of the game body.

4. The swinging and revolving game apparatus according to claim 1, wherein a slot on the left and right sides of the top of the game unit.

* * * * *